US006149470A

United States Patent [19]

Northey et al.

[11] Patent Number: 6,149,470

[45] Date of Patent: Nov. 21, 2000

[54] ELECTRICAL CONNECTOR FOR ANTENNA OR THE LIKE

[75] Inventors: William A. Northey; Walter C. Funk, Jr., both of Etters, Pa.

[73] Assignee: Berg Technology, Inc., Reno, Nev.

[21] Appl. No.: 09/259,006

[22] Filed: Feb. 26, 1999

[51] Int. Cl.[7] ..... H01R 33/00

[52] U.S. Cl. ..... 439/698; 439/940; 439/83; 343/906; 343/702

[58] Field of Search ..... 439/856, 857, 439/876, 698, 83, 940, 816, 861, 830; 343/702, 742, 870, 878, 741, 906

[56] References Cited

U.S. PATENT DOCUMENTS

| | | | |
|---|---|---|---|
| 2,777,118 | 1/1957 | Sundt | 439/698 |
| 2,924,809 | 2/1960 | Wilson | 439/573 |
| 4,556,274 | 12/1985 | Olivera | 439/621 |
| 4,628,322 | 12/1986 | Marko et al. | 343/702 |
| 4,924,237 | 5/1990 | Honda et al. | 343/702 |
| 4,940,992 | 7/1990 | Nguyen et al. | 343/803 |
| 5,113,196 | 5/1992 | Ponce de Leon et al. | 343/744 |
| 5,258,892 | 11/1993 | Stanton et al. | 361/814 |
| 5,300,938 | 4/1994 | Maroun et al. | 343/702 |
| 5,391,098 | 2/1995 | Ohashi | 439/830 |
| 5,394,160 | 2/1995 | Iwasaki et al. | 343/702 |
| 5,627,551 | 5/1997 | Tsuru et al. | 343/700 MS |
| 6,024,585 | 2/2000 | Mickievicz | 439/83 |

FOREIGN PATENT DOCUMENTS 0 902 508 A2 3/1999 European Pat. Off. .

*Primary Examiner*—Lincoln Donovan
*Assistant Examiner*—Brian S. Webb
*Attorney, Agent, or Firm*—Woodcock Washburn Kurtz Mackiewicz & Norris

[57] ABSTRACT

An electrical connector is disclosed for being mounted on a board and for connecting a loop antenna to a circuit on the board. The antenna connector has a connector block and first and second terminals. The connector block is constructed from a non-conductive material and has opposing top and bottom faces, first and second opposing side faces, and a center portion extending between the top face and bottom face. The center portion defines first and second bays isolated from each other, where the first and second bays are exposed at the top and bottom faces. The first and second bays are further exposed, respectively, at the first side face and the second side face. The first and second terminals are mounted in the first and second bays of the connector block. Each terminal is constructed from a conductive material and has an open jaw positioned at the top face of the connector block, and a contacting portion opposite the open jaw and positioned at the bottom face of the connector block. The antenna connector is mounted to the board such that the bottom face of the connector block faces the board, and such that the contacting portions of the first and second terminals are in electrical contact with corresponding pads on such board. The first and second terminals respectively receive a first end and a second end of the loop antenna.

39 Claims, 2 Drawing Sheets

ELECTRICAL CONNECTOR FOR ANTENNA OR THE LIKE

FIELD OF THE INVENTION

The present invention relates to an electrical connector for being mounted on a board and for connecting a loop antenna or the like to a circuit on the board. In particular, the present invention is for such an electrical connector comprising a connector block and first and second terminals mounted to the connector block.

BACKGROUND OF THE INVENTION

In relatively small, high frequency applications, such as personal pagers and the like, a relatively small loop antenna is connected to a circuit on a board within such pager. As should be understood, such loop antenna receives pager signals broadcast from a remote source, and couples such received signals to the circuit on the board within the pager. Such loop antenna may also transmit signals from the circuit on the board to the remote source.

In previous devices, the ends of the loop antenna are soldered directly to the circuit board by hand, or else a pair of clips are soldered to the circuit board by hand and the loop antenna is mounted to the clips and is thereby electrically contacted to the circuit board. However, either hand soldering operation is slow and cumbersome and prone to human error. Accordingly, a need exists for an antenna connector that can be machine mounted on a board, and that the loop antenna can be machine-inserted.

SUMMARY OF THE INVENTION

The present invention satisfies the aforementioned needs by providing an electrical connector for being mounted on a board and for connecting a loop antenna or the like to a circuit on the board. The connector has a connector block and first and second terminals. The connector block is constructed from a non-conductive material and has generally opposing top and bottom faces, first and second generally opposing side faces, and a center portion extending between the top face and bottom face. The center portion defines first and second bays isolated from each other, where the first and second bays are exposed at the top and bottom faces. The first bay is further exposed at the first side face, and the second bay is further exposed at the second side face.

The first and second terminals are mounted in the first and second bays of the connector block. Each terminal is constructed from a conductive material and has an open jaw generally positioned at the top face of the connector block, and a contacting portion generally opposite the open jaw and generally positioned at the bottom face of the connector block. The antenna connector is mounted to the board such that the bottom face of the connector block faces the board, and such that the contacting portions of the first and second terminals are in electrical contact with corresponding pads on such board. The first terminal receives a first end of the loop antenna, and the second terminal receives a second end of the loop antenna.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF PREFERRED EMBODIMENTS

Figure 1:
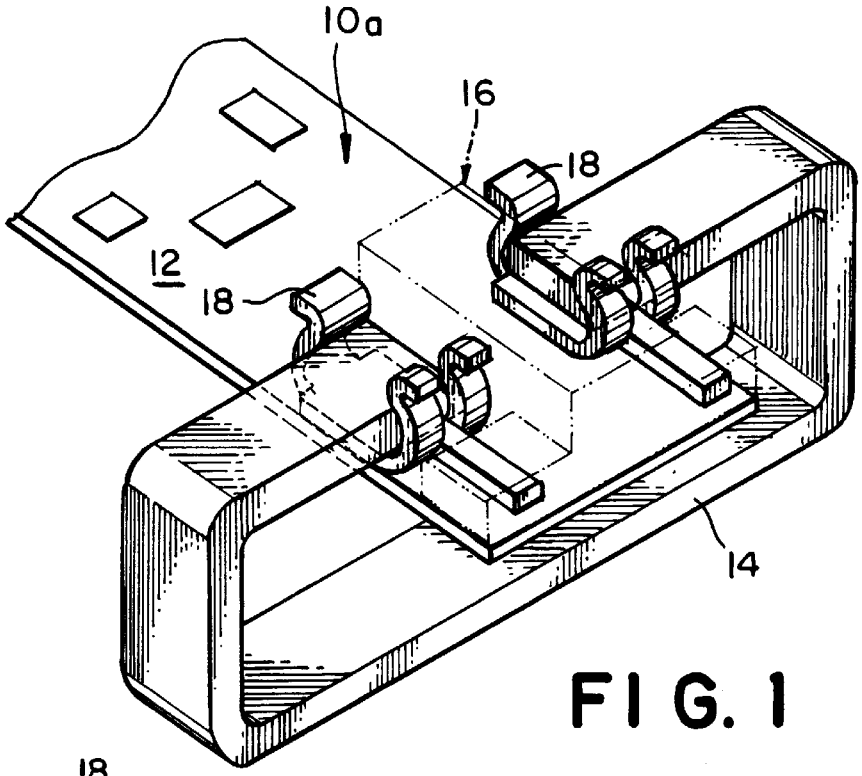
FIG. 1 is a plan view of an electrical connector in accordance with one embodiment of the present invention, and shows such antenna connector mounted on a board and connecting a loop antenna to a circuit on the board.

Certain terminology may be used in the following description for convenience only and is not considered to be limiting. The words "left", "right", "upper", and "lower" designate directions in the drawings to which reference is made. The words "inwardly" and "outwardly" are further directions toward and away from, respectively, the geometric center of the referenced object. The terminology includes the words above specifically mentioned, derivatives thereof, and words of similar import.

Referring to the drawings in detail, wherein like numerals are used to indicate like elements throughout, there is shown in FIG. 1 an electrical connector 10*a* in accordance with one embodiment of the present invention. As seen, the connector 10*a* is for being mounted on a printed circuit board 12 or the like, and is for connecting a loop antenna 14 or the like to a circuit on the board 12. In one typical scenario, and as was described above, the printed circuit board 12 may fit within a personal pager that requires a receiving and perhaps transmitting loop antenna 14. Since the typical personal pager is relatively small, the printed circuit board 12 is also relatively small as is the loop antenna 14. For example, the loop antenna 14 may have a defined perimeter of about two inches by about one half inch. Typically, and as shown, such loop antenna 14 loops from a first end off and under the printed circuit board 12 and then back up and on to the printed circuit board 12 at a second end. Of course, other antenna configurations may be employed without departing from the spilit and scope of the present invention.

Figure 2A:
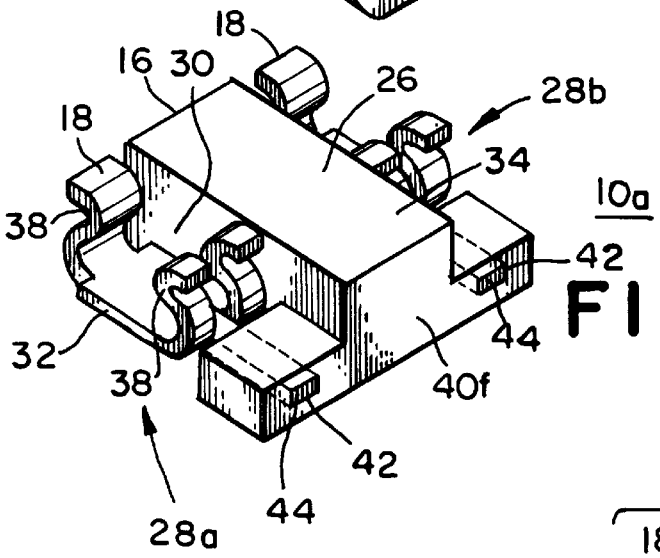
FIGS. 2A, 2B and 2C, are perspective, side, and plan views, respectively, of the connector of FIG. 1.
Figure 2B:
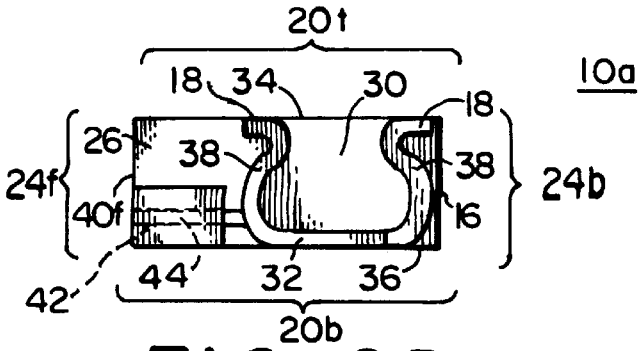
Figure 2C:
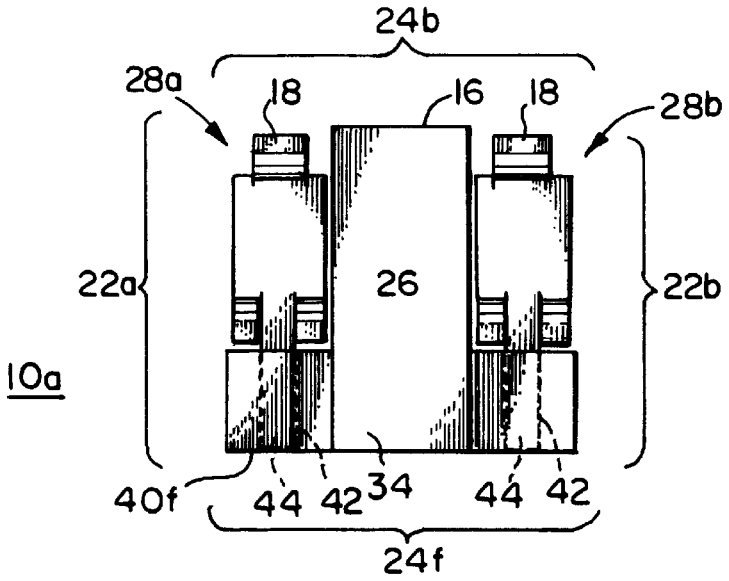

Referring now to FIGS. 2A–2C, it is seen that the connector 10*a* includes a connector block 16 flanked by first and second terminals 18. Note that the same connector 10*a* is shown in FIG. 1, although the connector block 16 is shown in phantom in FIG. 1 for purposes of clarity in viewing the first and second terminals 18 shown therein. The connector block 16 is preferably constructed from a non-conductive insulative material such as a polymer, a ceramic, an elastomeric material, or the like. However, other non-conductive materials may be employed without departing from the spirit and scope of the present invention. As seen, the connector block 16 has generally opposing top and bottom faces 20*t*, 20*b*, first and second generally opposing side faces 22*a*, 22*b*, and generally opposing back and front faces 24*b*, 24*f*. As should be understood, each face 20*t*, 20*b*, 22*a*, 22*b*, 24*b*, 24*f* corresponds to a presentation of a side of the connector block 16 and not necessarily to a particular physical aspect of such side. As seen, the connector block 16 has a center portion 26 that extends between the top face 20*t* and the bottom face 20*b* and that defines first and second bays 28*a*, 28*b* that are isolated from each other by such center portion 26. As also seen, the center portion 26 extends between the front face 24*f* and the back face 24*b*.

As seen, the first and second bays, 28*a*, 28*b* are exposed at the top and bottom faces 20*t*, 20*b* of the connector block 16. Moreover, the first bay 28*a* is exposed at the first side face 22*a*, and the second bay 28*b* is exposed at the second side face 22*b*. In fact, in the embodiment shown in FIGS. 2A–2C, such bays 28*a*, 28*b* are relatively largely exposed and relatively minimally defined by the connector block 16. However, and as will be seen below, in other embodiments of the present invention, such first and second bays 28*a*, 28*b* may be relatively minimally exposed and relatively largely defined by the connector block 16 while still being within the spirit and scope of the present invention.

The first and second terminals 18 are mounted in the first and second bays 28*a*, 28*b* of the connector block 16. As seen, the first and second terminals 18 are generally identical, although it will be recognized that non-identical first and second terminals 18 may be employed without departing from the spirit and scope of the present invention. Each of the first and second terminals 18 is constructed from a conductive material, such as a brass material, a bronze material, a stainless steel material, a copper material, or the like.

Preferably, the method of constructing terminals 18 is by stamping from a sheet of material and bending, or by molding. However, it will be recognized that other materials and other methods of construction may be employed without departing from the spirit and scope of the present invention. As best seen in FIG. 2B, each terminal 18 has an open jaw 30 generally positioned at the top face 20*t* of the connector block 16. In addition, and also as best seen in FIG. 2B, each terminal 18 has a contacting portion 32 generally opposite the open jaw 30 and generally positioned at the bottom face 20B of the connector block 16.

Preferably, and as seen in FIG. 1, the connector 10*a* is mounted to the board 12 such that the bottom face 20*b* of the connector block 16 faces the board 12 and such that the contacting portions 32 of the first and second terminals 18 are in electrical contact with corresponding pads (not shown) on such board 12. Typically, such contacting portions 32 are soldered in place in the aforementioned electrical contact with the corresponding pads to secure the first and second terminals 18 to the board 12. Such soldering may be achieved by any known soldering process. Of course, other methods of securely electrically connecting the contacting portions 32 to the pads to secure the terminal 18 to the board may be employed without departing from the spirit and scope of the present invention. As but one example, brazing may be employed. In addition to terminals 18 being secured to board 12, the connector block 16 may also be secured to the board 12 by any appropriate means. As should be understood, and still referring to FIG. 1, the first terminal 18 receives the first end of the loop antenna 14 and the second terminal 18 receives the second end of the loop antenna 14.

As seen in FIGS. 2A–2C, the top face 20*t* of the connector block 16 includes a generally flat top surface 34. More preferably, the flat top surface 34 is associated with the center portion 26 such that such center portion 26 extends between the flat top surface 34 of the top face 20*t* and the bottom face 20*b*. As may be appreciated, such flat top surface 34 allows the connector 10*a* to be picked up at such flat top surface 34 by a vacuum pick-and-place machine (not shown) in an automated fashion and placed in mounting relation to the board 12. Accordingly, such placing operation may be automated. Such vacuum pick-and-place machines and their operation are known and therefore need not be further described herein any detail.

Of course, other non-vacuum pick-and-place machines may be employed to pick up and place the connector 10*a* in an automated manner without departing from the spirit and scope of the present invention. For example, a grabber-type pick-and-place machine may be employed, and may user grabbers that grab at the front and back faces 24 *f*, 24*b* of the connector 10*a* in the region of the center portion 26. Such grabber-type and other non-vacuum pick-and-place machines and their operation are known and therefore need not be further described herein any detail. If in fact such a non-vacuum machine is employed, the aforementioned top surface 34 need not necessarily be flat.

The bottom face 20*b* may also comprise a generally flat bottom surface 36 (FIG. 2B) such that the connector 10*a* when placed in mounting relation to the board 12 is in intimate contact therewith. However, such flat bottom surface 36 is not believed necessary to the present invention, and circumstances may in fact dictate that the bottom surface 36 have a predefined contour. Moreover, it may be advantageous to provide the bottom surface 36 of the connector block 16 with keying features keyed to corresponding keying features on the board 12. For example, such bottom surface 36 may have a series of alignment posts (not shown) keyed to a series of apertures (not shown) in the board 12 such that the posts and apertures precisely position the connector block 16 and connector 10*a* on the board 12.

If the bottom surface 36 is indeed generally flat and the location of placement of the connector 10*a* on the board 12 is also generally flat, it is preferable that each contacting portion 32 of each terminal 18 be generally flat, that each contacting portion 32 reside in a plane generally parallel to the bottom surface 36/bottom face 20*b* of the connector block 16. Preferably, each contacting portion 32 is indeed generally coextensive with the bottom surface 20*b* /bottom face 36 of the connector block 16.

Still referring to FIGS. 2A–2C, each terminal 18 is preferably a snap-in terminal 18 such that the first end of the loop antenna 14 snaps into the first terminal 18 and the second end of the loop antenna 14 snaps into the second terminal 18. More preferably, each terminal 18 is generally U-shaped and has a pair of side portions 38 that extend from the contacting portion 32 and define the open jaw 30. Alternatively, each terminal 18 has only one side portion 38 which cooperates with an opposing body that is not part of the terminal 18 to define the open jaw 30 (not shown). In the preferred case of a pair of side portions, and as best seen in FIGS. 2A and 2B, each side portion 38 generally exhibits an S-shape such that the part of the side portion 38 adjacent the top surface 34 of the connector block 16 flares out. Preferably, each side portion 38 is reasonably compliant and the bays 28*a*, 28*b* are sized to reasonably allow compliant movement of such side portions. Accordingly, and as should be evident, such flaring, such compliance, and such sizing all contribute to facilitate the snap-in function. Once snapped in, the first and second ends of the loop antenna preferably maintain an interference fit within the respective first and second terminals 18. Accordingly, each end maintains good electrical contact with the respective terminal and cannot move around within such respective terminal.

In the embodiment of the invention shown in FIGS. 2A–2C, the connector block 16 has a front portion 40*f* that extends along the front face 24*f* between the first and second side faces. As should be appreciated, such front portion 40*f* further defines the first and second bays. As seen in FIGS. 2A–2C, the front portion 40*f* includes a front part of the center portion 26, and has half-high wings that extend from such center portion 26 toward the first and second side faces 22*a*, 22*b* of the connector block 16. However, the front portion 40*f* may have another design without departing from the spirit and scope of the invention, as long as such other design is consistent with the function of such front portion 40*f*, as will be described below.

In the embodiment shown in FIGS. 2A–2C, the front portion 40*f* has an aperture 42 extending there into from each bay 28*a*, 28*b*, and each terminal 18 has an extending member 44 that extends into the aperture 42 to anchor such terminal 18 to the connector block 16. As seen, each aperture 42 and each extending member 44 extends through the front portion 40*f* in a direction generally perpendicular to the front face 24*f* of the connector block 16. However, other arrangements of apertures 42 and extending members 44 may be employed without departing from the spirit and scope of the present invention, as long as the anchoring function is achieved. For example, the aperture 42 and extending member 44 may extend into the front portion 40*f* a shortened distance and at a slight upward inclination. Preferably, the extending member 44 is keyed to the aperture 42 to the extent necessary to prevent rotation or other similar movement of the extending member 44 within the aperture 42.

The extending member 44 may maintain an interference fit with the aperture 42. Alternatively, the extending member 44 may be secured in the aperture 42 by glue, epoxy, or other securing materials. If not secured as such, the connector block 16 could be removed (by machine or otherwise) after the terminals 18 have been soldered in place on the board 12. Note, though, that it may be preferable to leave the connector block 16 in place, such as to define and/or limit the placement of the loop antenna 14.

In the embodiment of the present invention shown in FIGS. 2A–2C, the extending member 44 is separated from the adjacent side portion 38 of the terminal 18, and then folded down and out. In particular, such adjacent side portion 38 is provided with a pair of slits to define a middle sub-portion between two exterior sub-portions, and the middle portion is bent down to form the extending member 44 while leaving the remaining exterior portions as such side portion 38. Of course, any appropriate method of formation may be employed to form the extending portion 44 without departing from the spirit and scope of the present invention. For example, molding or bending may be employed in any of a variety of ways.

Figure 3A:
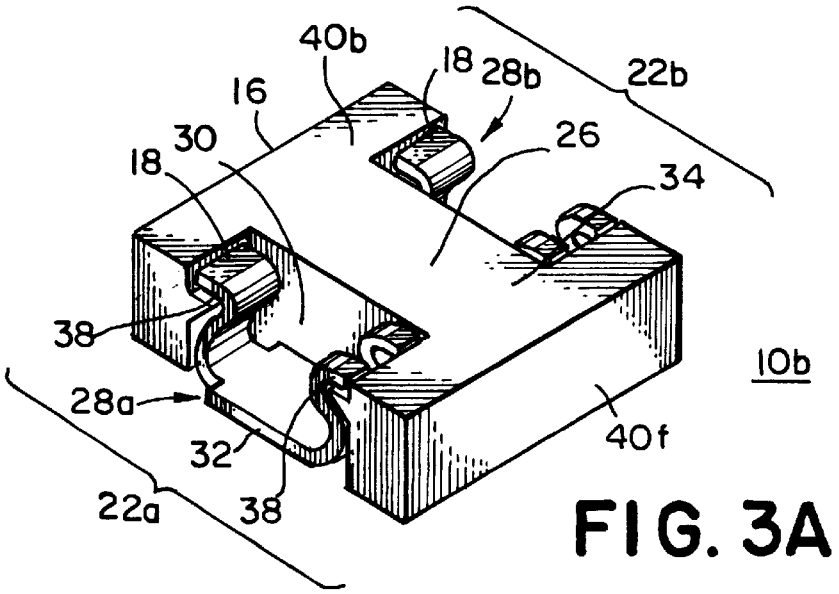
FIGS. 3A and 3B are perspective and side views of an electrical connector in accordance with another embodiment of the present invention.
Figure 3B:
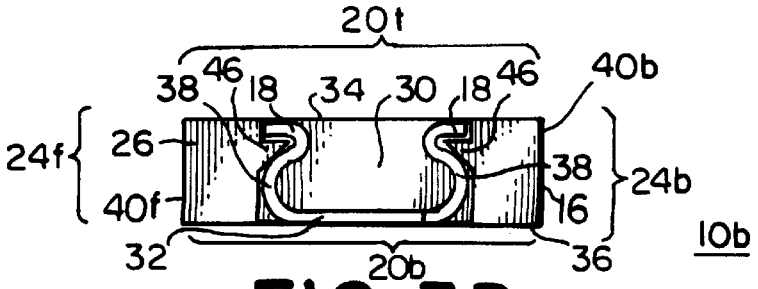

Referring now to FIGS. 3A and 3B, an electrical connector 10*b* is shown in accordance with another embodiment of the present invention. As seen, the connector 10*b* is similar to the connector 10*a* except that the connector block 16 of the connector 10*b* has, in addition to a front portion 40*f*, a back portion 40*b* that extends along the back face 24*b* between the first and second side faces 22*a*, 22*b*. As should be appreciated, such back portion 40*b* further defines the first and second bays 28*a*, 28*b* in combination with the front portion 40*f*. As seen in FIGS. 3A and 3B, the front portion 40*f* and back portion 40*b* both include a part of the center portion 26, and have full-height wings that extend from such center portion 26 toward the first and second side faces 22*a*, 22*b* of the connector block 16. However, the front portion 40*f* and back portion 40*b* of the embodiment shown in FIGS. 3A and 3B may have another design without departing from the spirit and scope of the invention, as long as such other design is consistent with the function of such front portion 40*f* and back portion 40*b*, as will be described below.

In the embodiment of the present invention shown in FIGS. 3A and 3B, each terminal 18 has the same general U-shape as before. However, no extending portion is provided. Rather, the side portions 38 of each terminal 18 extend generally along the front portion 40*f* and the back portion 40*b*, respectively, of the connector block 16. As should now be understood, such side portions 38 are arranged at an appropriate pitch with respect to the contacting portion 32 to allow such side portions 38 and such terminal 18 to maintain an interference fit in the respective bay 28*a*, 28*b* between the front portion 40*f* and the back portion 40*b*.

Preferably, in the embodiment of the present invention as seen in FIGS. 3A and 3B, each bay 28*a*, 28*b* includes front and back projections 46 that extend into the bay from the front portion 40*f* and back portion 40*b*, respectively. More preferably, the projections 46 extend toward the side portions 38 and cooperate with the bent area of the side portion 38 adjacent the flared out area thereof. Accordingly, such projections 46 support each terminal, assist in maintaining the interference fit of each terminal, and prevent the terminal from moving in a direction perpendicular to the top face 20*t* of the connector block 16. Of course, such projections 46 should not impede the snap-in function of the terminals 18.

As seen in FIGS. 2A–2C, the connector 10*a* could be symmetrical as between the first and second side faces 22*a*, 22*b*. As seen in FIGS. 3A and 3B, the connector 10*b* could also be symmetrical as between the first and second side faces 22*a*, 22*b*; and in addition be symmetrical as between the front and back faces 24*a*, 24*b*. Such double symmetry could be useful in that either face 24*a*, 24*b* may be 'the front face 24*a*'. However, such double symmetry in the connector 10*b*, and the single symmetry in the connector 10*a*, are not required for practicing the present invention.

In either connector 10*a* or 10*b*, and as seen from the drawing figures, the first and second terminals 18 are arranged in the first and second bays 28*a*, 28*b* of the connector block 16 such that the loop antenna 14 extends away from the first side face 22*a* of the connector block 16 adjacent the first end of such loop antenna 14, and such that the loop antenna 14 extends away from the second side face 22*b* of the connector block 16 adjacent the second end of such loop antenna 14. Put another way, the first end of the loop antenna 14 approaches toward the first side face 22*a* of the connector block 16 and the second end of the loop antenna 14 approaches toward the second side face 22*b* of the connector block 16. However, other arrangements may be employed without departing from the spirit and scope of the present invention. As but one example, the first end may instead approach toward the front face 24*a* of the connector block 16 and the second end may instead approach toward the back face 24*b* of the connector block 16.

Since, as was discussed above, the typical personal pager is relatively small, as is the loop antenna 14, the connector 10*a*, 10*b* is also relatively small. In one embodiment of the present invention, then, the center portion 26 of the connector block 16 has a width of about 0.08 inches and a depth of about 0.17 inches, each terminal 18 has a width of about 0.06 inches and a depth of about 0.12 inches, and the center-lines of the terminals 18 are spaced apart about 0.14 inches. Of course, other dimensions may be employed without departing from the spirit and scope of the present invention.

In the foregoing description, it can be seen that the present invention comprises a new and useful connector 10*a*, 10*b* for being mounted on a board 12 and for connecting a loop antenna 14 to a circuit on the board 12. Importantly, such connector 10*a*, 10*b* can be machine mounted on a board via an appropriate pick-and place machine or the like, and the loop antenna 14 can likewise be machine connected to such connector 10*a*, 10*b* via appropriate machinery (not shown). It should be appreciated that changes could be made to the embodiments described above without departing from the inventive concepts thereof. For example, multiple terminals 18 may be employed in the connector 10*a*, 10*b* for receiving each end of the loop antenna 14 (not shown). Alternatively, or in addition, multiple extending members 44 may be peeled off from the adjacent side portion 38 of the terminal 18 of the connector 10*a*, thereby leaving a number interior sub-portions as well as two exterior sub-portions (not shown). In either case, retention of each end of the loop antenna 14 is improved, as is the electrical connection. It should be understood, therefore, that this invention is not limited to the particular embodiments disclosed, but it is intended to cover modifications within the spirit and scope of the present invention as defined by the appended claims.

What is claimed is:

1. An electronic device comprising:

a substrate having a plurality of conductive traces thereon;

a pair of conductive clips, each clip being secured to a respective one of the traces, each clip having a pair of generally opposing deflectable extensions that define a jaw and a side face generally perpendicular to the jaw; and an antenna having a first end including a first insertion portion removably secured to one of the pair of clips through the jaw thereof and a second end including a second insertion portion removably secured to the other of the pair of clips through the jaw thereof, wherein the pair of conductive clips are secured to the traces such that the first insertion portion of the first end of the antenna extends away from a first one of the clips through the side face thereof and in a first direction generally parallel to the substrate and the second insertion portion of the second end of the antenna extends away from a second one of the clips through the side face thereof and in a second direction generally parallel to the substrate and generally opposite the first direction.

2. The device of claim 1 further comprising:

an insulative block mounted on the substrate and having first and second generally opposing side faces, each of the pair of clips being associated with a respective side face of the block.

3. The device of claim 2 wherein the block includes a generally flat top surface that allows the block to be picked up by a vacuum pick-and-place machine and placed in mounting relation to the substrate.

4. The device of claim 2 wherein each clip includes a contacting portion that is generally flat and that resides in a plane generally parallel to a bottom face of the block.

5. The device of claim 4 wherein each contacting portion is generally coextensive with the bottom face of the block.

6. The device of claim 2 wherein each clip is generally U-shaped.

7. The device of claim 2 wherein each clip is a snap-in clip such that the respective ends of the antenna snap thereinto.

8. The device of claim 2 wherein the block further has generally opposing back and front faces and a center portion extending between the front face and back face.

9. The device of claim 8 wherein the block further has a front portion extending along the front face between the first and second side faces and defining first and second bays within which the first and second clips reside.

10. The device of claim 9 wherein the front portion has an aperture extending thereinto from each bay, and wherein each clip further has an extending member extending into the aperture to anchor such clip to the block.

11. The device of claim 9 wherein the block further has a back portion extending along the back face between the first and second side faces and further defining the first and second bays.

12. The device of claim 11 wherein each clip is generally U-shaped and has a pair of side portions extending from a contacting portion and defining an open jaw, the side portions extending generally along the front portion and the back portion, respectively, of the block, and allowing the clip to maintain an interference fit in the respective bay between the front portion and the back portion.

13. An electrical connector comprising a pair of conductive terminals for securing an electrical component to a substrate, each terminal comprising:

a base having opposing ends;

a first deflectable extension projecting from one of the ends of the base;

a second deflectable extension projecting from the other of the ends of the base and cooperating with the first extension to removably retain the component therebetween, the second extension including a pair of spaced-apart arms;

the electrical connector further comprising an insulative block coupled to the pair of terminals, the block being mountable on the substrate and having first and second generally opposing side faces, each terminal being associated with a respective side face of the block and mountable to the substrate, each terminal being adapted to removably secure respective ends of an electrical component thereto, the block further having generally opposing back and front faces and a center portion extending between the front face and back face, the block still further having a front portion extending along the front face between the first and second side faces and defining first and second bays within which the first and second terminals reside, wherein the front portion has an aperture extending thereinto from each bay, wherein each terminal further has an extending member extending into the aperture to anchor such terminal to the block, and wherein the extending member comprises a third arm extending from between the pair of spaced-apart arms.

14. The connector of claim 13 wherein the block includes a generally flat top surface that allows the connector to be picked up by a vacuum pick-and-place machine and placed in mounting relation to the substrate.

15. The connector of claim 13 wherein the base of each terminal is generally flat and resides in a plane generally parallel to a bottom face of the block.

16. The connector of claim 15 wherein the base of each terminal is generally coextensive with the bottom face of the block.

17. The connector of claim 13 wherein each of the pair of terminals further comprises an open jaw opposite the base, the open jaw being formed by the first and second extensions and being adjacent a top surface of the block, the respective ends of the electrical component being inserted into the terminals through a plane coextensive with the top surface of the block.

18. An electrical connector for securing an electrical component having ends to a substrate, the connector comprising:

an insulative block mountable on the substrate and having first and second generally opposing side faces, and first and second terminals each associated with a respective side face of the block, mountable to the substrate, and adapted to removably secure respective insertion portions of ends of the electrical component thereto, each terminal having a pair of generally opposing deflectable extensions that define a jaw and a side generally perpendicular to the jaw, the insertion portions being secured to the terminals through the respective jaws, wherein the insertion portion of a first end of the electrical component extends through the side of the first terminal and away from the first terminal at the associated side face and in a first direction generally parallel to the mounted-to substrate and the insertion portion of a second end of the electrical component extends through the side of the second terminal and away from the second terminal at the associated side face and in a second direction generally parallel to the mounted-to substrate and generally opposite the first direction.

19. The connector of claim 18 wherein the block includes a generally flat top surface that allows the connector to be picked up by a vacuum pick-and-place machine and placed in mounting relation to the substrate.

20. The connector of claim 18 wherein each terminal includes a contacting portion that is generally flat and that resides in a plane generally parallel to a bottom face of the block.

21. The connector of claim 20 wherein each contacting portion is generally coextensive with the bottom face of the block.

22. The connector of claim 18 wherein each terminal is generally U-shaped.

23. The connector of claim 18 wherein each terminal is a snap-in terminal such that the respective ends of the electrical component snap thereinto.

24. The connector of claim 18 wherein the connector block further has generally opposing back and front faces and a center portion extending between the front face and back face.

25. The connector of claim 24 wherein the connector block further has a front portion extending along the front face between the first and second side faces and defining first and second bays within which the first and second terminals reside.

26. The connector of claim 25 wherein the front portion has an aperture extending thereinto from each bay, and wherein each terminal further has an extending member extending into the aperture to anchor such terminal to the block.

27. The connector of claim 25 wherein the block further has a back portion extending along the back face between the first and second side faces and further defining the first and second bays.

28. The connector of claim 27 wherein each terminal is generally U-shaped and has a pair of side portions extending from a contacting portion and defining an open jaw, the side portions extending generally along the front portion and the back portion, respectively, of the block, and allowing the terminal to maintain an interference fit in the respective bay between the front portion and the back portion.

29. An antenna connector for being mounted on a board and for connecting a loop antenna to a circuit on the board, the antenna connector comprising:

a connector block constructed from a non-conductive material and having generally opposing top and bottom faces, first and second generally opposing side faces, and a center portion extending between the top face and bottom face and defining first and second bays isolated from each other, the first and second bays being exposed at the top and bottom faces, the first bay being further exposed at the first side face, the second bay being further exposed at the second side face, and first and second terminals mounted in the first and second bays of the connector block, each of the first and second terminals being constructed from a conductive material and having an open jaw defined by a pair of generally opposing deflectable extensions and generally positioned at the top face of the connector block, the extensions also defining a side of each terminal generally perpendicular to the jaw thereof, and a contacting portion generally opposite the open jaw and generally positioned at the bottom face of the connector block;

wherein the antenna connector is mounted to the board such that the bottom face of the connector block faces the board, and such that the contacting portions of the first and second terminals are in electrical contact with corresponding pads on such board;

wherein the first terminal receives an insertion portion of a first end of the loop antenna through the jaw thereof, and the second terminal receives an insertion portion of a second end of the loop antenna through the jaw thereof; and wherein the first and second terminals are arranged in the first and second bays of the connector block such that the insertion portions of the first and second ends of the loop antenna respectively extend through the side of the first terminal and away from the first side face of the connector block generally parallel to the mounted-to board and through the side of the second terminal and away from the second side face of the connector block generally parallel to the mounted-to board.

30. The antenna connector of claim 29 wherein the top face of the connector block includes a generally flat top surface, wherein the center portion extends between the flat top surface of the t op face and the bottom face, and wherein the flat top surface allows the antenna connector to be picked up by a vacuum pick-and-place machine and placed in mounting relation to the board.

31. The antenna connector of claim 29 wherein each contacting portion is generally flat and resides in a plane generally parallel to the bottom face of the connector block.

32. The antenna connector of claim 31 wherein each contacting portion is generally coextensive with the bottom face of the connector block.

33. The antenna connector of claim 29 wherein each terminal is generally U-shaped.

34. The antenna connector of claim 29 wherein each terminal is a snap-in terminal such that the first end of the loop antenna snaps into the first terminal and the second end of the loop antenna snaps into the second terminal.

35. The antenna connector of claim 29 wherein the connector block further has generally opposing back and front faces, and wherein the center portion extends between the front face and back face.

36. The antenna connector of claim 35 wherein the connector block further has a front portion extending along the front face between the first and second side faces and further defining the first and second bays.

37. The antenna connector of claim 36 wherein the front portion has an aperture extending thereinto from each bay, and wherein each terminal further has an extending member extending into the aperture to anchor such terminal to the connector block.

38. The antenna connector of claim 36 wherein the connector block further has a back portion extending along the back face between the first and second side faces and further defining the first and second bays.

39. The antenna connector of claim 38 wherein each terminal is generally U-shaped and has a pair of side portions extending from the contacting portion and defining the open jaw, the side portions extending generally along the front portion and the back portion, respectively, of the connector block, and allowing the terminal to maintain an interference fit in the respective bay between the front portion and the back portion.

* * * * *